US005107588A

United States Patent [19]

Undin et al.

[11] Patent Number: 5,107,588

[45] Date of Patent: Apr. 28, 1992

[54] METHODS OF PRODUCING INTERMEDIATES FOR CONNECTORS WITH INSULATED FERRULES

[75] Inventors: Hans Undin, Akersberga, Sweden; Bernhard Boche; Bernd David, both of Detmold, Fed. Rep. of Germany; Ulrich Wiebe, Dörentrup, Fed. Rep. of Germany

[73] Assignee: C. A. Weidmuller GmbH & Co., Detmold, Fed. Rep. of Germany

[21] Appl. No.: 584,693

[22] Filed: Sep. 19, 1990

Related U.S. Application Data

[63] Continuation-in-part of Ser. No. 386,451, Jul. 28, 1989, Pat. No. 4,981,451.

[30] Foreign Application Priority Data

Jan. 31, 1990 [DE] Fed. Rep. of Germany ..... 4002828

[51] Int. Cl.[5] ..... H01R 43/16

[52] U.S. Cl. ..... 29/885; 29/566.1; 29/753; 29/874; 29/876

[58] Field of Search ..... 29/874, 878, 876, 566.1, 29/885, 753

[56] References Cited

U.S. PATENT DOCUMENTS

| | | | |
|---|---|---|---|
| 2,410,321 | 10/1946 | Watts | 29/874 X |
| 2,654,873 | 10/1953 | Swengel | 29/874 X |
| 2,818,363 | 12/1957 | Woolley, Jr. | 29/878 |
| 2,855,581 | 10/1958 | Freedom | 29/874 X |
| 3,216,091 | 11/1965 | Floyd, Jr. | 29/876 X |
| 3,648,224 | 3/1972 | McDonough | 29/874 X |
| 3,660,805 | 5/1972 | McDonough | 29/874 X |
| 3,927,453 | 12/1975 | Zahn et al. | 29/566.1 |

FOREIGN PATENT DOCUMENTS

| | | | |
|---|---|---|---|
| 1221942 | 2/1971 | United Kingdom | 29/885 |
| 1232950 | 5/1971 | United Kingdom | 29/753 |

*Primary Examiner*—Carl J. Arbes

*Attorney, Agent, or Firm*—Cushman, Darby & Cushman

[57] ABSTRACT

Connectors with a barrel-shaped ferrule are produced from an intermediate which is embodied by metallic strip consisting of a plurality of connector blanks linked together by interconnecting means, each blank comprising a first ferrule-forming part and a second tongue-forming part, and including a first zone which comprises all the first parts, and an adjacent second zone which comprises all the second parts and all the interconnecting means, the side edges of neighbouring first parts in the strip being separated by free interspaces and a continuous layer or cover of insulating material being adhesively applied on the first zone, on at least one obverse surface of the strip, so as to extend beyond a terminal edge of the first part, the said layer being within said interspaces cut through and bent so as to form at least one flap sufficiently large to adhere when folded back.

26 Claims, 5 Drawing Sheets

METHODS OF PRODUCING INTERMEDIATES FOR CONNECTORS WITH INSULATED FERRULES

This is a continuation-in-part of our earlier application Ser. No. 07/386,451 filed Oct. 28, 1990, which issued as U.S. Pat. No. 4,981,451 on Jan. 1, 1991.

FIELD OF THE INVENTION

The present invention refers to methods of producing intermediates for contact elements, i.e. for connectors or terminals such as cable shoes, which have ferrules, i.e. barrel-shaped connection or attachment portions by which the contact elements may be crimped onto end portions of insulated electrical conductors. The invention refers specifically to contact elements whose ferrules are insulated. The invention refers also to intermediates and contact elements produced by the methods.

"Intermediates" are in the present description and in the attached claims understood as such intermediate products, i.e. single pieces (individual blanks), or a contiguous plurality of pieces (connector strips or bands), in which the part defining the barrel-shaped ferrule in the finished connector is still flat, or at the utmost only partially bent.

BACKGROUND OF THE INVENTION

Cable shoes are in the broadest sense understood as connectors which have a connecting portion in the shape of a hollow cylinder or a barrel-shaped ferrule, and a contact portion ("tongue"). The contact portion, e.g. in the form of a fork or of an eye, has the purpose of establishing electrical contact with a co-operating connector means, e.g. a stationary clamping screw. "Tongue" is in the present description and in the enclosed patent claims understood as any contact portion of a connector or terminal (be it of cable-shoe-type, or of end-sleeve-type).

The ferrule defines a portion for mechanical connection with, i.e. attachment to, the uninsulated end of an electrical conductor in order to establish electrical contact therewith.

Both the ferrule portion, and the contact portion consist of metal. The inserted conductor end does not extend beyond the ferrule, i.e. it does not penetrate into the contact portion. The ferrule, covered with an insulating layer, is afixed to the conductor by crimping.

Another type of terminals are end-sleeves, i.e. connector elements in which the stripped end of an electrical conductor is inserted into the contact portion (sleeve portion) and is crimped therein. There are also end-sleeves known which are provided either with a non-insulated metallic ferrule, or with a ferrule consisting exclusively of insulating material. The purpose of the metallic ferrule is to be crimped onto the insulation of the respective conductor, so as to reinforce the mechanical attachment of the end-sleeve to the conductor.

"Aderend-type end-sleeves with a plastic collar" are well known types of end-sleeves where non-metallic, all-plastic extruded collar portions (e.g. of polypropylen), also called "insertion funnels", are attached to all-metallic contact or sleeve portions in lieu of ferrules.

When such an end-sleeve is to be mounted on the bare end of a conductor (generally a multi-wire conductor), the conductor is stripped along a length corresponding to the length of the contact portion, and is through the insertion funnel introduced into the contact portion as to be there, and only there, crimped to a desired, possibly non-circular, cross-sectional profile, e.g a trapezoidal one.

The plastic collar loosely surrounds the end part of the conductor's insulation without seizing it firmly, because, not being made of metal, it cannot be crimped. For the same reason occupies the plastic insertion collar more space than a metallic ferrule, so that conductors provided with such end-sleeves cannot be crammed together so tightly as some connecting strips, with which the end-sleeves shall co-operate, demand.

Cable shoes and end-sleeves, besides of being produced individually, are also produced in the above mentioned strips or bands ("strip or band material"), and are removed therefrom first when they, e.g. by roll crimping, are attached to a conductor.

Various methods of producing intermediates for connectors with insulated ferrules have been described, e.g. in the U.S. Pat. Nos. 2,786,191 to Broske and 2,845,606 to Fuller.

According to the first named patent, a strip of sheet metal connector blanks, interconnected by slugs, is laminated with sheet plastic which subsequently is stamped out to leave an extension beyond the metal which can be formed into an insulation supporting sleeve. The blanks are so close together that there is no sufficient spacing between two neighbouring blanks for the insulation to be there folded back to the reverse side of the blank. The other patent describes a blank where metal is folded around plastic, not plastic around metal.

Insulation layers on ferrules, as well as the above mentioned insertion funnels, can be made in selected colors (e.g. red, yellow, green) defining color codes indicating a recommended range of conductor cross-sections for which the respective connector or terminal is best suited (e.g. in accordance with proposed German Standard DIN 46228, part 4, concerning the above mentioned so called "Aderend" end-sleeves with extruded collars).

OBJECTS OF THE INVENTION

It is a primary object of the invention to provide economical methods of producing intermediates, embodied either by strip material, or by individual blanks, which lead to connectors with insulated ferrules of metal. Another object of the invention is to provide intermediates for the production of improved wire end ferrules of the "Aderend" type which can be tightly packed together, and which, like in cable shoes, firmly grasp also the end portion of the insulation of the respective conductor, so that a plurality of conductors provided with such wire end ferrules can be connected to narrowly spaced terminals in a connecting strip or the like. Still another object of the invention is to provide a method how to economically obtain an insulated ferrule in a connector which is affixed to a conductor by a so called B-shaped crimp.

SUMMARY OF THE INVENTION

The said objects and others, which will become apparent hereinafter, are attained, according to a first aspect of the in invention, by a method comprising the steps of producing a metallic punching band or stamped metal strip of a given thickness consisting of a plurality of connector blanks linked together by interconnecting means such as bridges or slugs, each blank comprising two parts, viz. a first, flat, ferrule-forming part which has a given height and is limited by two side edges and one end edge, and a second, tongue-forming part which projects, opposite the said end edge, from a fourth edge of the first part, the strip having an obverse surface corresponding to the outer face of the finished ferrule, and a reverse surface corresponding to the inner face of the finished ferrule, the two said surfaces including a first zone which is limited by a terminal edge of the strip, has said height, and comprises all the first parts, and an contiguous second zone which comprises all the said second parts and all the interconnecting means, the side edges of neighbouring first parts in the strip being separated by free interspaces having a length equal to a substantial multiple of said thickness of the strip;

adhesively applying, exclusively on the first zone, and at least on the said obverse surface, a continuous layer, cover or stripe of insulating material having a width which with a selected addition surpasses said height so as to extend beyond said terminal edge;

cutting-through the said layer, cover or stripe at a selected location within each said interspace, and bending or folding back the insulating flaps thus obtained, and having a length equal to a substantial multiple of said thickness, with 180° round at least one of the side edges flanking the respective interspace.

Said insulating layer may be applied by either of the specific methods which will be declared more in detail below.

According to a second aspect of the invention, a method of producing said intermediate comprises the steps of producing at least one blank of metal comprising two parts, viz. a first, flat, ferrule-forming part which has a given height and is limited by two side edges and one end edge, and a second tongue-forming part which opposite said end edge projects from a fourth edge of the first part, said at least one blank having an obverse surface corresponding to the outer face of the finished ferrule, and a reverse surface corresponding to the inner face of the finished ferrule, producing for each first part an individual, double-walled envelope member of insulating material, whose two walls are connected at least along the two said side edges, and slipping said envelope member on said first part so as to have the first part entirely enclosed in the envelope member.

The double-walled envelope member can be selected from a group comprising:

a member made entirely of not resilient material and dimensioned so that it as a bag may be slipped on a first part;

a member made entirely of resilient material and dimensioned so that it may be slipped on a first part only after having been extended;

a member having at least one wall made of material shrinkable by heat and dimensioned so that it in unshrunk condition may be slipped on a first part and shrunk when in place;

a member having at least one wall made of material extendable by heat and dimensioned so that it only in heated condition may be slipped on a first part so as to shrink there after cooling.

According to a third and fourth aspect of the invention, methods for said purposes comprise applying a coat of insulating varnish to the said first zone at least on the obverse surface thereof, or subjecting the first zone at least on the obverse surface to a powder baking process.

According to a fifth aspect of the invention, a method of affixing by a B-shaped crimp a connector, which has an insulated barrel-shaped ferrule, to a conductor, comprises the steps of producing a blank of metal comprising two parts, viz. a first, ferrule-forming part which is limited by an end edge and, at two side edge portions, by two side edges, and a second, tongue-forming part which opposite said end edge projects from a fourth edge of the first part, said at least one blank having an obverse surface corresponding to the outer face of the finished ferrule, and a reverse surface corresponding to the inner face of the finished ferrule, covering the obverse surface of the first part by a layer of insulating material having two lateral terminal parts adjacent said two side edge portions, and rolling-up the first part from both sides around the stripped end of the conductor so as to form a B-shaped crimp in which the said two lateral terminal parts of the insulating layer are squeezed between the said two side edge portions of the first part.

The thicknesses of the materials of the blanks and of the insulation, and the interspaces between these materials, are in some drawing figures exaggerated for clarity.

DETAILED DESCRIPTION OF PREFERRED EMBODIMENTS

Figure 1:
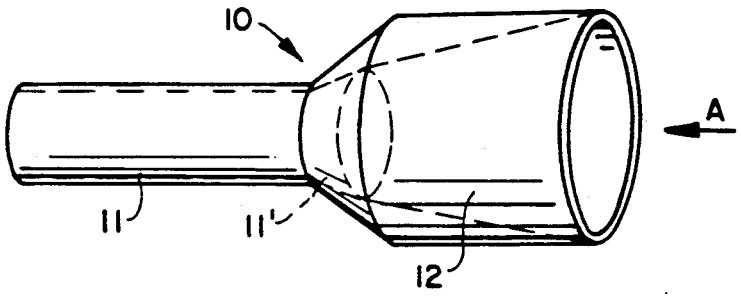
FIG. 1 (PRIOR ART)
FIG. 1 illustrates the prior art and is a perspective view of a "Aderend" type end-sleeve.
Figure 2:
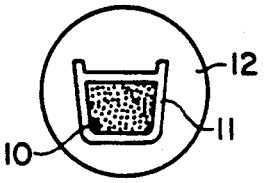
FIG. 2 (PRIOR ART)
FIG. 2 is a front view in the direction of the arrow II in FIG. 1.

According to FIGS. 1 and 2, a conventional, individually produced wire end ferrule 10 of the Aderend-type with an extruded plastic collar has a contact portion 11, defined by a hollow metallic cylinder, at one end 11' of which a plastic insertion collar or insertion sprout 12 made of insulating material is attached. The conductor 10 (FIG. 2), which at one end is stripped along a length corresponding to the length of the said cylinder, is inserted into the end-sleeve in the sense of arrow A, i.e. in its axial direction, and is thereafter crimped together with the contact portion, e.g. into a trapezoidal cross-sectional shape shown in FIG. 2. The plastic collar 12, the color of which has been selected as a signal code, loosely surrounds the insulation on the non stripped-off end part of the conductor.

According to a first aspect of the present invention, illustrated in FIGS. 3 through 19, an intermediate, embodied by a partially insulated metallic punching band or strip 20 (FIG. 3) or 120 (FIG. 5) of a kind known per se ("band material") is produced from a selected material with a selected thickness, e.g. from 0.5 mm thick brass plate.

Each band or strip consists of a plurality of connector blanks 30, 130 which are planar in all their parts and are interconnected by connecting means as slugs or connecting bridges 23, 123. Each blank comprises a first part 31, 131 and a second part 32, 132.

The first parts 31, 131 are essentially rectangular in shape, and are at least at the location, where they are attached to the second parts, narrower than the second parts, e.g. due to a restriction 33" (FIG. 14), or to two such restrictions 33, 133, one on each side (FIG. 13), in which latter case, the first and the second parts may have a common axis of symmetry D.

Consequently, the strips or bands 20, 120 comprise a first zone I with all the first parts 31, 131, and a thereto contiguous second zone II with all the second parts 32, 132 and all the connecting means. The strips have further an edge zone or carrier zone 120' (FIG. 5) which is provided with manipulating openings 120" for feeding the band forward in a crimping device.

Figure 3:
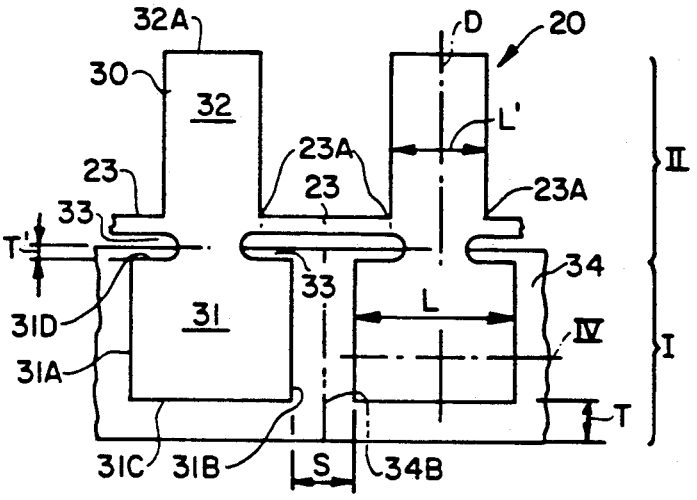
FIG. 3 shows in a plan view a portion of a punching band ("band material") for producing end-sleeves according to the invention.
Figure 5:
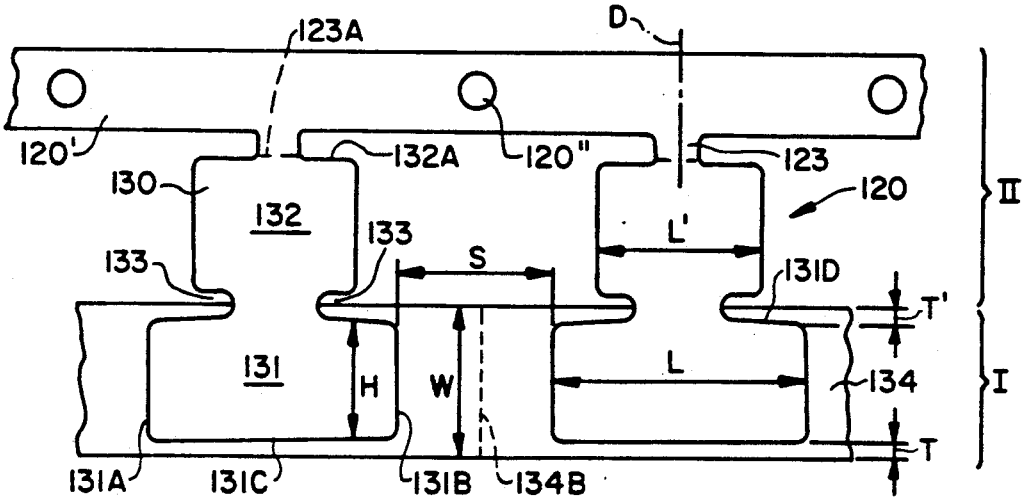
FIG. 5 shows in plan view a part of another punching band ("band material") for producing end-sleeves according to the invention.

The second parts 31C, 131C have, in the case of blanks for wire end ferrules or end-sleeves, also an essentially rectangular shape (as shown in FIGS. 3 and 5), and are at their free end terminated by a front edge 32A, 132A. The first parts 31, 131 are at their free end terminated by an end edge 32, 132 and are laterally limited by two side edges 31A, 31B, 131A, 131B.

According to FIGS. 3 and 5, the second parts 32, 132 are narrower than the first parts not only at the location of attachment, but also generally. The length dimensions L, L' (extending horizontally in FIGS. 3 and 5) of the first and second parts respectively correspond to the circumferential lengths of the connector and connection portions in the finished connector respectively, preferably with a small overlapping, as shown at B in FIGS. 9 and 12.

Figure 13:
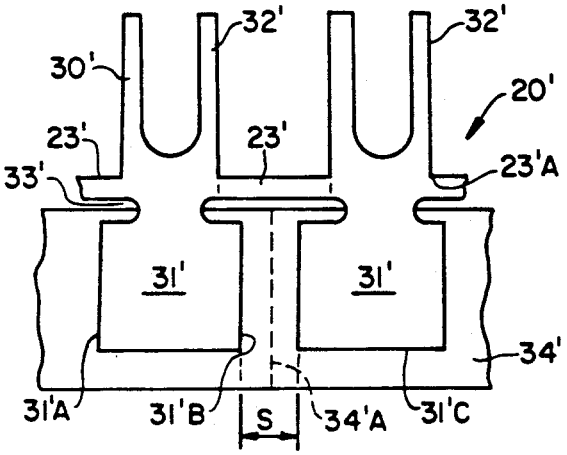
FIG. 13 shows in plan view a part of a band ("band material") for producing cable shoes according to the invention.
Figure 14:
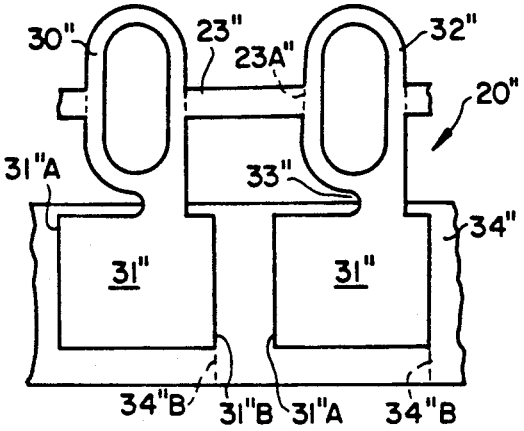
FIG. 14 shows in a plan view a part of another band ("band material") for producing cable shoes according to the invention.

The said restrictions 33, 133 allow the first part to be rolled-up or crimped to a different cross-sectional shape than the second part (which with cable shoes, FIGS. 13 and 14, is not rolled up at all).

On one side or face of the band 20, 120, viz. this one, which shall define the obverse face of the finished connector element, is a stripe of a suitable insulating material of selected thickness and color, e.g a 0.05 to 0.1 mm thick polyester foil, commercialized under the trademark "Mylar", applied (e.g. bonded, welded).

The spacing of the individual blanks one from another in the punching bands 20, 120 is selected so, by appropriate dimensioning the connecting bridges 23, or appropriately positioning the connecting bridges 123, that between each two neighbouring first parts 31, 131 of the blanks 30, 130 is a space S of selected, not negligeable length, equal to a substantial multiple of the thickness of the metal material, obtained which is flanked by the side edges 31A, 31B, 131A, 131B of the said neighbouring first parts. This space S remains free of any metallic material, being bridged only by the insulating stripe 34, 134.

Figure 4:
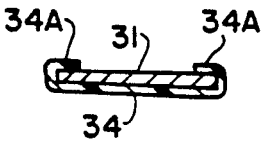
FIG. 4 is a cross-section along the plane IV—IV in FIG. 3, at a later production phase.
Figure 15:
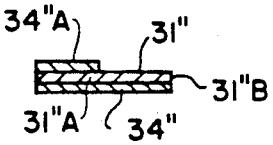
FIG. 15 is a cross-section along the plane XV—XV in FIG. 14, FIGS. 16 and 17 show two punches for crimping connector elements according to the invention.

The purpose of this arrangement is to enable for the insulating stripe 34, 134, after having been cut up, as will be explained below, to be bent around at least one of said flanking side edges 31A, 31B, 131A, 131B, as is illustrated in FIG. 15 at 34"A (bending around one side edge), and in FIGS. 4 and 7 at 34A (bending around two side edges) in order to insulate even the respective side edge.

The insulating stripe 34, 134 has a width W (FIG. 5) which is somewhat larger than the height H of the first parts 31, 131, but smaller than double this height. The stripe is so located, that it with a distance T reaches over the end edges 31C, 131C in order to achieve a safe insulation of this edge in the finished connector element, and optionally may also at the opposite edge 31D, 131D with a distance T' reach into the connecting area between the first and the second parts.

The punching band 20, 120, as well as the insulating stripe 34, 134, are each produced in a per se known manner. Alternative methods of applying an insulation to the first portion of a connector element according to the present invention will be described below, e.g. in connection with FIGS. 18 and 19.

Figure 6:
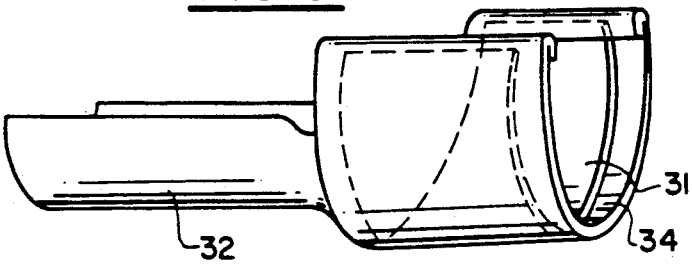
FIG. 6 is a perspective view, similar to that of FIG. 1, of a of a single, pre-bent blank, produced according to the the invention.

Preferably, the blanks 30, 130 may be, before crimping, partially pre-bent, i.e. bent into the shape shown in FIG. 6 where they define an open trough, but not yet a closed cylinder.

In principle it may be chosen, if the blanks, when provided with the insulation on their first portions, possibly after also having been pre-bent, be separated one from another to be further treated as individual connector elements, or if they, preferably, will be delivered as band material in strips of selected length separated one from another first in connection with being crimped onto the end of a conductor.

Upon separation, the connecting bridges 23, 123 are severed either on two locations (at 23A in the embodiment of FIG. 3) and disposed off, or on one location (at 123A in the embodiment of FIG. 5), so that they remain connected with the edge or carrier zone 120, and are disposed off therewith. Separation scores may be preferably provided at the respective locations 23A, 123A when the punching band is produced.

As already mentioned, also the insulating stripe 34, 134 is separated at a selected location 34B, 134, 34"B (FIG. 15) between two adjacent blanks 30, 130, and is then bent around one of the adjacent side edges (31"A, FIG. 15) or, when the location of separation lies in the central region of the space S, around both side edges 31A, 31B, 131A, 131B, and is then preferably made to adhere, i.e. by being bonded etc., to the reverse face of the respective first part.

An insulated conductor 10 has an insulating sheath or cover M (FIG. 9), which has been stripped at the end. A crimping device (such as a crimping tool or a crimping apparatus) has suitably shaped punches for the first parts 31, 131 and, in the case end-sleeves, also for the second parts. The end part of the conductor 10 may be from any arbitrary direction, i.e. not only in the longitudinal direction of the conductor, but also at right angles thereto, inserted into the blank, possibly a pre-bent one, which has been placed in the punch or punches.

When the crimping device is then operated, the first portion 31, 131 is crimped around the stripped end (in cable shoes) or (in end-sleeves) around the adjacent non-stripped end part of the conductor 10, generally into a cylindric shape (FIG. 9), and preferably with the above mentioned overlapping B of the side edge regions.

Figure 8:
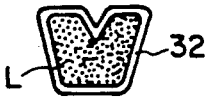
FIG. 8 shows in a front view in the direction of the arrow VIII in FIG. 6 an end-sleeve made of the blank of FIGS. 6 and 7 after crimping.

In the case of end-sleeves are at the same time the second parts 32, 132 in a suitable punch crimped around the stripped end of the conductor into a desired cross-sectional shape (FIG. 8). The part (distance T, FIGS. 3 and 5) of the insulating stripe 34, 134, which reaches over the end edge 31C, 131C assures uninterrupted connection between the insulation of the conductor and that of the connector element.

If the insulation stripe 34, 134 has been bent only around one side edge 31"A (FIG. 15), then this side edge has to lie uppermost after crimping, so as to cover the non insulated other side edge 32"B.

Figure 7:
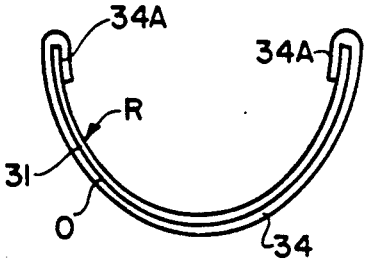
FIG. 7 shows the blank of FIG. 6 in a rear view in the direction of the arrow VII in FIG. 6.
Figure 9:
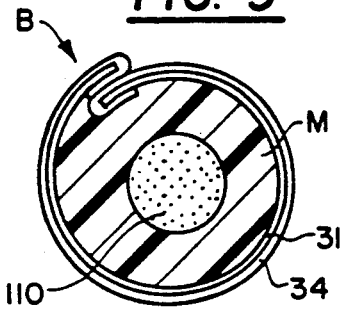
FIG. 9 is the same rear view as in FIG. 7 after the blank has been crimped onto a conductor.

In FIGS. 6 and 7 is shown a blank 30 taken from a punching band 20 according to FIG. 3 after pre-forming, and in FIGS. 8 and 9 are shown its first and second parts respectively after the final crimping.

Figure 10:
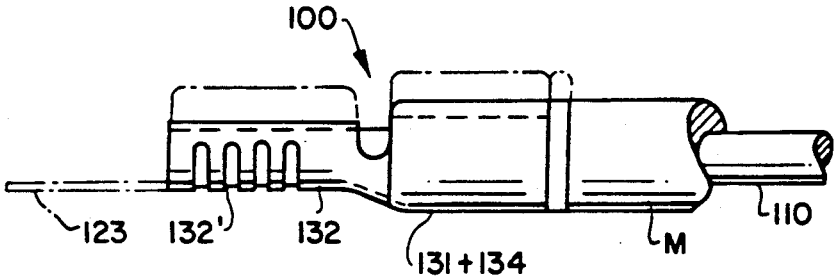
FIG. 10 is a side view of a finished end-sleeve produced according to the invention.
Figure 11:
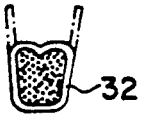
FIG. 11 is a front view of the end-sleeve of FIG. 10 in the direction of the arrow XI in FIG. 10.
Figure 12:
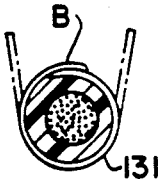
FIG. 12 is a rear view of the end-sleeve of FIG. 10 in the direction of the arrow XII in FIG. 10.

In FIGS. 10 to 12 is shown an end-sleeve 100 obtained from a blank 130 according to FIG. 5 after crimping, i.e. after having been attached to a conductor 10. By mixed lines is shown the outline of the pre-bent blank (before separation from the connecting bridge 123). In the second part 132, shaped into a connecting portion, is a plurality of indentations 132' provided which increase the strength of the mechanical attachment and which have been produced e.g. at the pre-shaping operation leading to the stage shown in FIG. 6. Alternatively, such indentations may be also produced immediately before the crimping operation (e.g. in a second punch).

An end-sleeve produced according to the present invention consists consequently of a metallic body which has been obtained by rolling up, in a per se known manner, two different, but contiguous parts of an originally flat blank 130, the connecting portion 131 of the end-sleeve, obtained from the first part 131 of the punching band, and intended to be crimped around an insulated part of the conductor, being at least on its outer face provided with an insulating cover.

In contrast to conventional end-sleeves with an insulating collar 12 (FIG. 1), the end-sleeve produced according to the present invention has, as already mentioned, the advantages of a more rational production, of a firmer mechanical attachment to the insulating cover of the conductor, and of a smaller over-all diameter. In contrast to conventional end-sleeves made of band material, the end-sleeve according to the present invention has the advantage of an insulating collar in any arbitrary color having the function of a code.

The punching band 20' of FIG. 13 differs from the punching band 20 of FIG. 3 only in that, that the blanks 30', with unchanged first parts 31', have second parts 32' which instead of end-sleeve contact portions define fork-shaped contact portions which are not to be further deformed, so that the end product is a cable shoe. The process differs from the one which was described in connection with FIG. 3 only in that the stripped end of the conductor is now not inserted into the second, but in the first portion 31' of the blank. The insulating stripe 34' with separation locations 34'A, and the connecting bridges 23' with separation locations 23'A correspond to the embodiment of FIG. 3.

There are also cable shoes in which the contact portion is not plane, but e.g. rolled up. It will be understood that also such cable shoes may be produced according to the invention, viz. in the same way as end-sleeves, but without inserting the conductor into the second portion.

Also the punching band 20" of FIGS. 14 and 15 comprises blanks for cable shoes. The connecting bridges 23" are located approximately in half the height of the second parts 32", the first parts 31" are separated from the second parts by a single restriction 33" (so that the blank 30" is no longer axially symmetrical), and the insulation stripe 34" is severed at 34"B, i.e. closely adjacent the side edge 31"B, and is bent around only one side edge 31"A of an adjacent blank.

Figure 16:
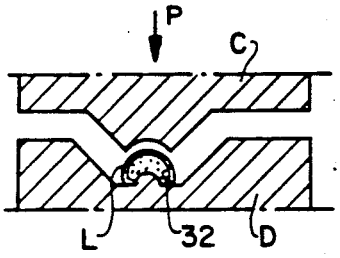

In FIG. 16 is shown how a second part 32 according to FIG. 6 is deformed in a die of a crimping device into a contact portion e.g. according to FIG. 8 or 11 (depending on the shape of the die). The press punch or die has two halves C and D which may be approached one to another in the sense of the arrow P.

Figure 17:
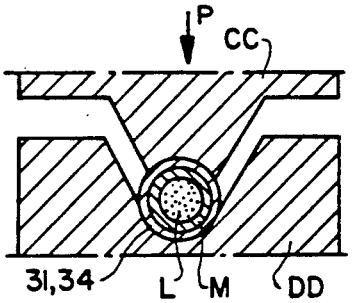

In FIG. 17 is shown how a first part 31, 34 according to FIG. 6 is deformed into a cylindrical, insulated connecting portion e.g. according to FIG. 9 in the die of a crimping device which comprises two halves CC, DD which may be approached one to another in the sense of the arrow P.

Figure 18:
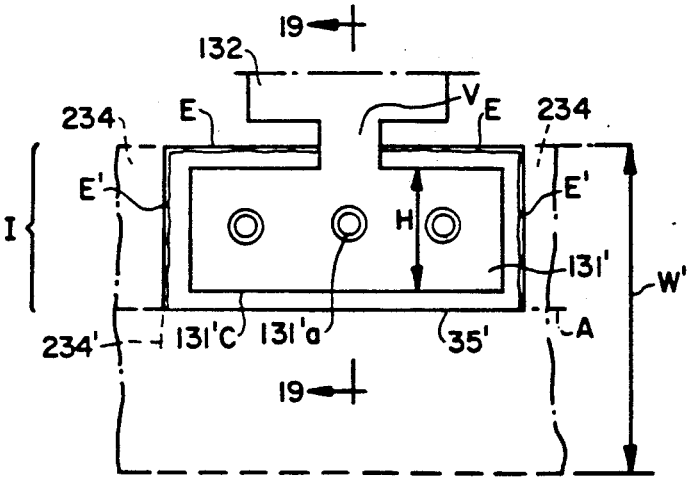
FIGS. 18 and 19 show in plan view and in a cross-section along the plane XIX—XIX in FIG. 18 respectively an alternative embodiment of the insulation.
Figure 19:
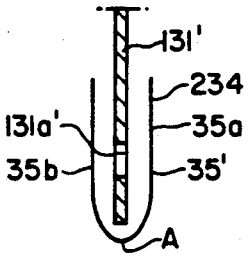
Figure 20:
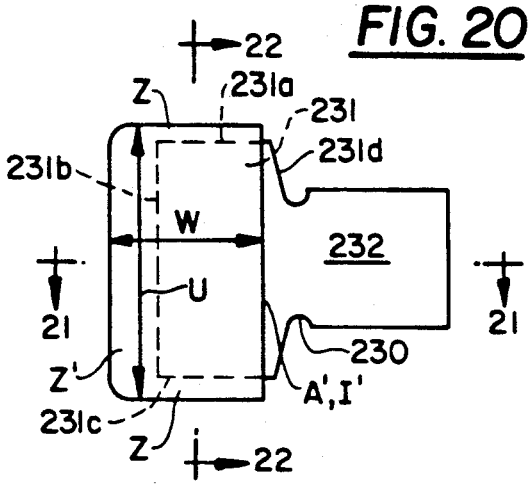
FIG. 20 shows another blank produced according to the invention.

In FIGS. 18 and 19 is shown an alternative method of applying an insulation to the first parts of the blanks. On each first part such as 131' is a bag 35' of insulating material slipped on and affixed by bonding or welding along at least one of its edges, e.g. edge E. From the study of FIG. 18 will be understood that one may start from a rectangular piece of the respective insulating material, somewhat larger than double the area of the first part 131' which has to be covered, that this piece is along a line A bent around the end edge 131C of the first part 131', and bonded or welded along its remaining edges (with the exception of the zone V at the connecting bridge). Also some other edge, e.g. one of the side edges E', may be used for said bending.

Preferably, however, a stripe of insulating material 234 is applied on an arbitrary face (obverse or reverse) of the zone I of the punching band, which comprises all the first parts, but in contrast to e.g. FIG. 3, the stripe 234 has now a width W' which corresponds to somewhat more than double the height H of the respective first part 131'. This stripe is bent around the end edge 131C of the first part 131 (or, more correctly, around the end edge of the zone I of the punching band) and is along its edge E (except in the area V) bonded or welded with the already present part. By cuts at 234' and, preferably, by bonding or welding along the edges E', the individual bags, analogous to the earlier described ones, are then produced.

For a still better attachment of the insulating bag, the first part 131' may be provided with at least one opening 131'a through which the two walls 35a, 35b of the bag 35' also are bonded or welded together.

A third alternative for applying an insulation on the first parts of a connector element according to the present invention is to apply a layer of an insulating varnish on at least one face (this, which shall define the outer face of the finished connector element) of the said zone I of the punching band by spraying or, preferably, by immersing this zone into a bath of such varnish.

A fourth alternative consists in subjecting at least said face of said zone to a powder baking process.

In FIGS. 20 to 24 is shown a flat blank 230, which may have been obtained individually or from a strip or a band, and from which a connector element which embodies an end sleeve 230' (FIG. 23) shall be produced according to another embodiment of the invention. The end sleeve 230' comprises a contact portion 232', into which extends the stripped end 10' of a conductor 10, and an insulated connecting portion 231'.

The blank 230 has a first part 231, which in the finished connector element 230, defines the connection portion 231', and a second part 232, which in the finished connector element defines the contact portion 232'.

Figure 21:
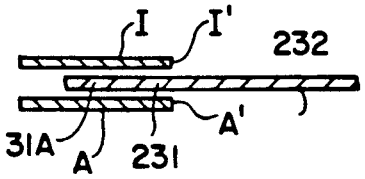
FIG. 21 is a longitudinal section along the plane XXI—XXI in FIG. 20.

The first part 231 of the blank 230 is on each its side or face 231', 231" (FIG. 22) covered with an insulating stripe A and I respectively (FIG. 21). The two stripes A, I are of a different nature. The outer face 231' of the first part 231, corresponding to the outer face of the connection portion 231' in the finished connector element 230, is covered with an insulating stripe A which primarily has good insulation qualities, and possibly shows a selected code color.

The inner face 231" of the first part 231, which corresponds to the inner face of the connection portion of the finished connector element 230, is covered with an insulating stripe I, the prime task of which is to insulate the two free side edges 231a, 231c, and the free end edge 231b of the first part 231, and which as a rule may be thinner than the stripe A. "Free edges"are understood as those three edges of the rectangular first part 231 of the blank 230, to which there is no second part 232 attached.

Both insulating stripes A, I are layed on the first part 231 so, that a longitudinal edge A', I' of these stripes extends substantially along the fourth edge 231d of the first part 231, and the stripes A, I have such a width W and such a length U that they on all said three free edges 231a-c project beyond the first part 231, i.e. follow the three free edges 231a-c with additions Z, Z'.

Figure 24:
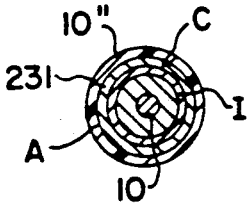
FIG. 24 is a cross-section along the plane XXIX—XXIV in FIG. 23.
Figure 25:
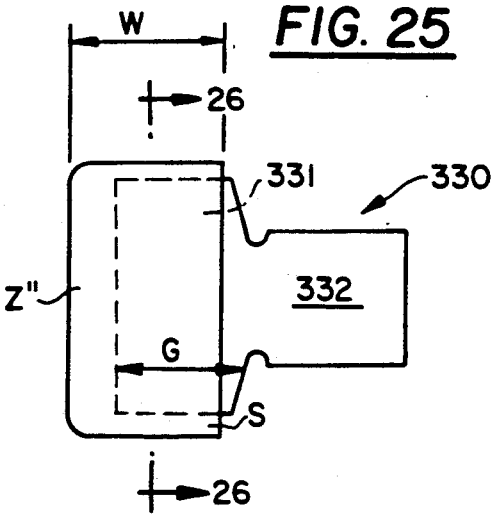
FIG. 25 shows still another blank according to the invention.

Within these additions Z, Z, are the two stripes A, I pasted, or by pressure and heat bonded, i.e. welded, together. In case of pasting, one or both stripes may be provided with a pasting layer on the entire face turned toward the blank, or only within the zones Z, Z'. However, it is advantageous if in particular the inner insulating stripe I is pasted etc. also to the metal of the first part 231, to adhere better thereto when it is rolled into a connection portion 231' (cfr. FIG. 24).

It is also advantageous if the additional zone Z' along the end edge 231c is dimensioned so as to embody, in the finished connector element 230, a collar F (see FIG. 23) which may adhere to the insulation 10" of the conductor 10.

Bonding one insulation stripe to another one, as the case is in the zones Z, Z', results in a more firm attachment than bonding an insulation stripe to metal, as the case is outside said zones.

Figure 22:
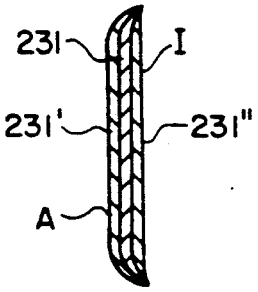
FIG. 22 is a cross-section along the plane XXII—XXII in FIG. 20.
Figure 23:
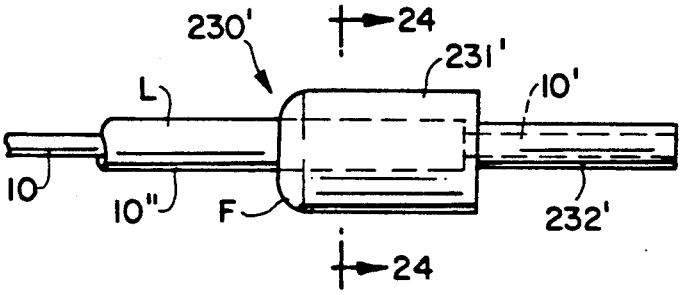
FIG. 23 shows a connector element produced by crimping the blank of FIG. 20 on a conductor.

Further, the inner insulation stripe I, and only this one, may preferably be made so as shrink after application, so that the state illustrated in FIG. 22 occurs, and the collar K adheres more intimately to the insulation 10" because only the inner stripe I has shrunk. Consequently, the side edge of the insulating stripe A adheres better to the insulating stripe I, as seen at C in FIG. 24.

Said shrinking may be obtained by the insulating stripe I, which consist e.g. of PVC or processed PVC, either being mechanically stretched at ambient temperature before being applied, or by being heated after application. In both cases occurs, after application on the blank, or after cooling down, the phenomenon illustrated in FIG. 22, viz. that the additional zones Z, Z' curl or are lifted in the direction toward the shrunk insulation stripe I.

Figure 26:
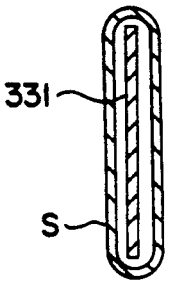
FIG. 26 is a cross-section along the plane XXVI—XXVI in FIG. 25.

In the FIGS. 25 to 29 is shown another alternative embodiment of the present invention according to which a shrinkable tubing S, preferably in a selected code color, is threaded on the first part 331 of a plane blank 330, as shown in cross-section according to FIG. 26. The tubing S has a length W" which is larger than the width G of the first part 331, so that an addition Z" is obtained.

The tubing S, which may consist of an inherently resilient or dilatable material, and/or which may be shrunk in the same two ways as described above, can before application be cut into appropriate pieces having the lengths W".

Figure 27:
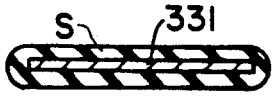
FIG. 27 is a cross-section as in FIG. 26, but at a later production stage.
Figure 29:
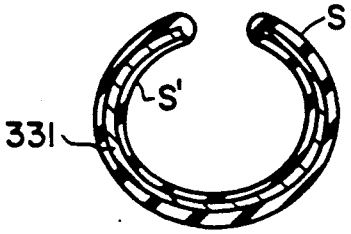
FIG. 29 is a cross-section through the connector element of FIG. 28 at a later production stage.

The tubing S is the by welding, bonding, or the like closed in the region of the addition Z", and after it has been threaded on the first part 331, and has contracted or shrunk (which, in contradistinction to the earlier described alternative, now occurs along both faces of the blank), a cross-section according to FIG. 27 is obtained.

Figure 28:
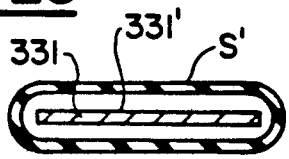
FIG. 28 is a cross-section, in analogy to that of FIG. 26, through yet another blank for producing a connector element according to the invention.

Preferably, the tubing S may be thinner in the region S', which covers the inner face 331, (FIG. 28) of the first part 331, than elsewhere, so that, after having been threaded on the said first part 331, a cross-section according to FIG. 28, rather than according to FIG. 26, is obtained. The thinner part S' of the tubing may preferably be bonded to the blank in order to well adhere to the metal when the first part 331 is rolled up.

Figure 30:
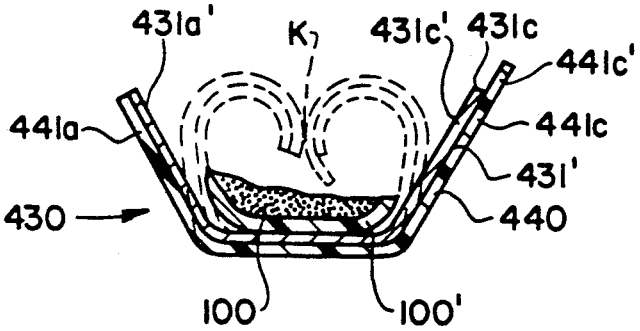
FIG. 30 is a cross-sectional view of a connector element for affixing by a B-shaped crimp to a multi-wire conductor.
Figure 31:
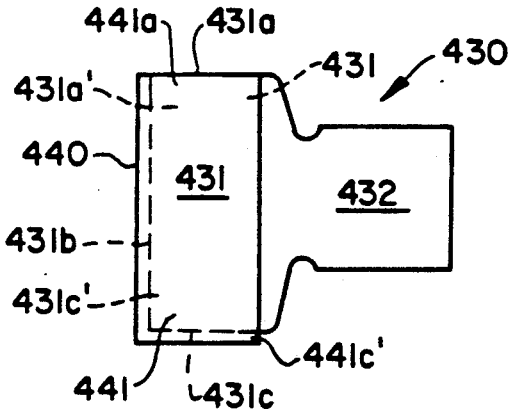
FIG. 31 is a plan view of the intermediate for the connector of FIG. 30.

In FIGS. 30 and 31 is shown how an intermediate 430 may be affixed to the insulated (insulation layer 100') end 100 of a multi-wire conductor 100 by a so-called B-crimp (or B-shaped crimp). The intermediate 430 has a first part 431, which has the cross-sectional shape of a trough, and is limited, on the one hand, by an end edge 431*b* and on the other hand, laterally, by two side edges 431*a*, 431*c* and has, adjacent said side edges, side edge portions 431*a'*, 431*c'*. The second part 432 of the intermediate may have any desired shape.

The obverse surface 431' of the first part 431 is covered by a layer 440 of insulating material which has, adjacent said side edge portions 431*a'*, 431*c'* of the intermediate, lateral terminal portions 441*a*, 441*c*. The layer 440 may be, or may be not, bonded to the said obverse surface 431'.

The insulating layer 440 may extend from one side edge of the fist part 431 to the other, as is shown at the side edge 431*a* in the left hand part of FIG. 30 and in the upper part of FIG. 31, or it may, by a projecting portion such as 441*c'*, extend beyond the adjacent side edge, as is shown in with the side edge 431*c* in FIGS. 30 and 31. Preferably, but not necessarily, only one of the two alternatives is used at a time.

When the intermediate 430 is—in a known manner—crimped upon a conductor by what is known as a B-crimp, the two side portions 431*a'*, 431*c'* are rolled up, each from its side, as is shown in phantom lines in FIG. 30, whereby the lateral terminal parts 441*a*, 441*b* of the relatively soft insulating layer 440 become at K firmly squeezed between the two relatively hard side edge portions 431*a'*, 431*c'* of the first part, which now come to lie closely adjacent one another.

In the alternative with the insulating layer projecting laterally beyond the first part, the projecting portion such as 441*c'* may be, before the crimp, folded with 180° around the respective side edge such as 431*c*, thus securing that the insulating layer will not be pushed back in the crimping operation.

It will be appreciated that the main purpose of a possible bonding of the insulating layer to the intermediate is to hold the said two parts together in the pre-operational stage (e.g. upon storage). It will be also appreciated that the first part of the intermediate may be covered by the insulating layer either while it still is flat, or after it has been bent into the trough shape.

We claim:

1. A method of producing an intermediate for connectors which have insulated barrel-shaped ferrules, comprising the steps of producing a metallic punching band or stamped metal strip of a given thickness consisting of a plurality of connector blanks linked together by interconnecting means such as bridges or slugs, each blank comprising a first, flat, ferrule-forming part which has a given height and is limited by two side edges and one end edge, and a second, tongue-forming part which projects, opposite said end edge, from a fourth edge of the first part, the strip having a first surface corresponding to the outer face of the finished ferrule, and a second surface corresponding to the inner face of the finished ferrule, each said surface including a first zone which is limited by a terminal edge of the strip, has said height, and comprises all the first parts, and a contiguous second zone which comprises all the second parts and all the interconnecting means, the side edges of neighboring first parts in the strip being separated by free interspaces having a length equal to a substantial multiple of said thickness of the strip;

adhesively applying, exclusively on the first zone, and at least on said first surface, a continuous layer, cover or stripe of insulating material having a width which with a selected addition surpasses said height so as to extend beyond said terminal edge;

cutting-through said layer, cover or stripe at a selected location within each said interspace to form at least one insulating flap, and bending or folding back each said insulating flap, and having a length equal to a substantial multiple of said thickness, with 180° round at least one of the side edges flanking the respective interspace.

2. The method of claim 1, wherein said addition is at least as large as double said height, said layer or cover is first applied to one of said two surfaces, and then folded back with 180° parallel with said terminal edge, and bonded to the other of the two surfaces.

3. The method of claim 1, wherein the insulating layer, cover or stripe is cut-through closely adjacent one of the side edges which flank the respective interspace to form a single flap, and the single flap thus obtained is bent or folded back round the other side edge flanking the interspace, and which other side edge in the finished ferrule is located outwardly of the one side edge.

4. The method of claim 1, wherein the insulating layer, cover or stripe is cut-through in a central are of the interspace to form two insulting flaps, and the two insulating flaps thus obtained are bent or folded back round both side edges flanking the interspace.

5. The method of claim 1, wherein at least the layer, cover or stripe on the second surface of the metallic strip is bonded to the strip.

6. The method of claim 1, wherein both said surfaces of the first zone are covered by an insulating cover or layer, and at least one opening is provided in the first parts, and the two layers or covers are bonded together in these openings.

7. The method of claim 1, wherein both said surfaces of the first zone are covered by an insulating cover, layer or stripe, and this cover, layer or stripe is thinner on the second surface than on the first surface.

8. The method of claim 1, wherein both said surfaces of the first zone are covered by an insulating cover, layer or stripe, and the two covers, layers or stripes are bonded together along at least one of the side edges which in the finished ferrule lies outwardly of the other side edge.

9. The method of claim 1, wherein at least one constriction is provided between the first and the second part of the blank, and at least the first part of the blank is pre-bent so as to define a not quite closed ferrule.

10. The method of claim 1, wherein the second part of the blank is shaped to define the contact portion of a wire end ferrule of the Aderend-type, and the first part is shaped to define an insertion funnel of said ferrule.

11. A method of producing an intermediate for connectors which have insulated barrel-shaped ferrules, comprising the steps of producing at least one blank of metal comprising a first, flat, ferrule-forming part which has a given height and is limited by two side edges and one end edge, and a second tongue-forming part which projects, opposite said end edge, form a fourth edge of the first part, said at least one blank having a first surface corresponding to the outer face of the finished ferrule, and a second surface corresponding to the inner face of the finished ferrule, producing for each first part an individual, double-walled envelope member of insulating material, whose two walls are connected at least along the two said side edges, and slipping said envelope member on said first part so as to have the first part entirely enclosed int eh envelope member.

12. The method of claim 11, wherein at least one constriction is provided between the first and the second part of the blank, and at least the first part is prebent so as to define a not entirely closed ferrule.

13. The method of claim 11, wherein the second part of the blank is shaped to define the contact portion of a wire end ferrule of Aderend-type, and the first part is shaped to define an insertion funnel of said ferrule.

14. The method of claim 11, wherein the double-walled envelope member is one of:

a member made entirely of not resilient material and dimensioned so that it as a bag may be slipped on a first part;

a member made entirely of resilient material and dimensioned so that it may be slipped on a first part only after having been extended;

a member having at least one wall made of material shrinkable by heat and dimensioned so that it in unshrunk condition may be slipped on a first part and shrunk when in place; and a member having at least one wall made of materail extendable by heat and dimensioned so that it only in heated condition may be slipped on a first part so as to shrink there after cooling.

15. The method of claim 14, wherein, the envelope member, only the part defining the wall adjacent the second surface is of said shrinkable material, so that the side edges of the envelope member become bent in the direction away from the first surface when the wall has shrunk.

16. The method of claim 14, wherein, in the envelope member, only the part defining the wall adjacent the first surface is of sad extendable material, so that the side edges of the envelope member become bent in the direction away from the first surface when the wall has retracted.

17. The method of claim 14, wherein the envelope member has a thinner wall adjacent the second surface than adjacent the first surface.

18. The method of claim 14, wherein the envelope member is produced by a rectangular piece of insulating material, corresponding in shape to said first part of said blank plus, along at least one of the side edges, a selected additional zone, being applied to each of said two surfaces, and the two rectangular pieces being bonded together within said additional zone to define a bag.

19. The method of claim 14, wherein the envelope member is produced by a rectangular piece of insulating material, corresponding to two adjacent first parts of said blank plus a selected additional zone located along at least one of the side and end edges, is applied to one of sad two surfaces of the first part and folded in half with 180° round one of said side and end edges, and the two folds thus obtained are bonded together within said additional zone so as to define a bag.

20. The method of claim 14, wherein at least the wall or fold at the second surface is made to adhere to the blank.

21. A method of producing an intermediate for connectors which have insulated barrel-shaped ferrules, comprising the steps of producing a punching band or stamped metal strip consisting of a plurality of connector blanks linked together by interconnecting means such as bridges or slugs, each blank comprising a first ferrule-forming part and a second tongue-forming part projecting form the first part, said strip having a first surface corresponding tot he outer face of the finished ferrule, and a second surface corresponding to the inner face of the finished ferrule, and including a first zone comprising all the first parts, and a contiguous second zone comprising all the second parts and all the interconnecting means;

applying a coat of insulating varnish to said first zone at least one ht first surface thereof.

22. The method of claim 21, wherein both surfaces are provided with a coat of insulating varnish by immersing said first zone into a bath of insulating varnish.

23. A method of producing an intermediate for connectors with insulated ferrules, comprising the steps of producing a metallic punching band or stamped metal strip consisting of a plurality of connector blanks linked together by interconnecting means such as bridges or slugs, each blank comprising a first ferrule-forming part and second tongue-forming part, said strip having a first surface corresponding to the outer face of the finished ferrule, and a second surface corresponding to the inner face of the finished ferrule, and including a first zone comprising all the first parts, and a contiguous second zone comprising all the second parts and all the interconnecting means;

providing at least the first surface of said firs zone with an insulating layer or cover by subjecting it to a powder baking process.

24. A method of affixing by a B-shaped crimp to a connector, which has an insulated barrel-shaped ferrule, to a conductor, comprising the steps of producing a blank of metal comprising a first, ferrule-forming part which is limited by an end edge and, at two side edge portions, by two side edges, and a second, tongue-forming part which opposite said end edge projects from a fourth edge of the first part, said at least one blank having a first surface corresponding to the outer face of the finished ferrule, and a second surface corresponding to the inner face of the finished ferrule, covering the first surface of the first part with a layer of insulating material having two lateral terminal parts adjacent said two side edge portions, and rolling-up the first part from both sides around the stripped end of the conductor and forming a B-shaped crimp in which said two lateral terminal parts of the insulating layer are squeezed between said two side edge portions of the first part and onto end of the stripped conductor.

25. The method of claim 24, wherein at least one of said lateral terminal parts extends beyond said side edges, and is before the crimp folded back around the adjacent side edge.

26. The method of claim 24, wherein the insulating layer is bonded to said first surface.

* * * * *